US009185988B1

(12) United States Patent
Sanchez

(10) Patent No.: US 9,185,988 B1
(45) Date of Patent: Nov. 17, 2015

(54) SOLAR WIRELESS BEACH CHAIR

(71) Applicant: Maximino Sanchez, Brooklyn, NY (US)

(72) Inventor: Maximino Sanchez, Brooklyn, NY (US)

( * ) Notice: Subject to any disclaimer, the term of this patent is extended or adjusted under 35 U.S.C. 154(b) by 0 days.

(21) Appl. No.: 14/490,548

(22) Filed: Sep. 18, 2014

Related U.S. Application Data

(60) Provisional application No. 61/879,651, filed on Sep. 18, 2013.

(51) Int. Cl.

| | |
|---|---|
| ***A45B 23/00*** | (2006.01) |
| ***A47C 7/66*** | (2006.01) |
| ***A47C 4/48*** | (2006.01) |
| ***A47C 7/72*** | (2006.01) |

(52) U.S. Cl.
CPC ... *A47C 7/66* (2013.01); *A47C 4/48* (2013.01); *A47C 7/72* (2013.01); *A45B 23/00* (2013.01); *A45B 2200/1027* (2013.01)

(58) Field of Classification Search
CPC .. A45B 2200/1027; A45B 23/00; A47C 7/72; A47C 7/66
USPC ..... 135/16; 320/101
See application file for complete search history.

(56) References Cited

U.S. PATENT DOCUMENTS

| | | | | |
|---|---|---|---|---|
| 4,936,594 | A * | 6/1990 | Oliver, III | 280/47.19 |
| 6,923,194 | B2 | 8/2005 | Li | |
| 7,793,121 | B2 | 9/2010 | Lawther | |
| D625,169 | S | 10/2010 | Quinn | |
| D625,507 | S | 10/2010 | Quinn | |
| D625,509 | S | 10/2010 | Quinn | |
| 8,002,349 | B1 * | 8/2011 | Pizzuto | 297/217.3 |
| 8,104,491 | B2 | 1/2012 | Li | |
| 8,297,294 | B2 | 10/2012 | Li | |
| 8,345,889 | B2 * | 1/2013 | Li | 381/77 |
| 8,453,659 | B2 * | 6/2013 | Li | 135/16 |
| 8,497,656 | B2 * | 7/2013 | Portis et al. | 320/101 |
| 8,733,378 | B2 * | 5/2014 | Tayebi | 135/16 |
| 2005/0161067 | A1 * | 7/2005 | Hollins | 135/16 |
| 2005/0242635 | A1 | 11/2005 | Cassaday | |
| 2007/0236058 | A1 * | 10/2007 | Yeider | 297/184.1 |
| 2007/0242450 | A1 | 10/2007 | Blatecky | |
| 2007/0283987 | A1 | 12/2007 | Reyes et al. | |
| 2008/0092936 | A1 | 4/2008 | Carabillo | |
| 2009/0058354 | A1 | 3/2009 | Harrison | |
| 2009/0268923 | A1 | 10/2009 | Li | |
| 2010/0192999 | A1 * | 8/2010 | Li | 135/96 |
| 2010/0326849 | A1 | 12/2010 | Trimarche | |
| 2011/0265694 | A1 | 11/2011 | Portis et al. | |
| 2011/0273133 | A1 | 11/2011 | Sala | |
| 2012/0073616 | A1 | 3/2012 | Kuelbs | |
| 2012/0235477 | A1 * | 9/2012 | Korman | 307/11 |

(Continued)

*Primary Examiner* — Noah Chandler Hawk
(74) *Attorney, Agent, or Firm* — QuickPatents; Kevin Prince

(57) ABSTRACT

An improvement for a collapsible beach chair includes an umbrella mechanism that has a rigid support post fixed with an expandable canopy. The canopy includes at least one flexible solar panel and power lines electrically connected with an umbrella electrical connector. A clamping mechanism supports the umbrella mechanism with one of a pair of back support posts of the chair. A chair electrical connector cooperative with the umbrella electrical connector is electrically connected with a pair of audio transducers each fixed with one of a pair of armrests of the chair. Each audio transducer is adapted for receiving a wireless audio signal and reproducing such signal audibly. A rechargeable battery and powered USB ports may further be provided, as well as pockets suspended from the arm rests of the chair to enclose the audio transducers and the rechargeable battery.

8 Claims, 5 Drawing Sheets

(56) References Cited

U.S. PATENT DOCUMENTS

2012/0305414 A1* 12/2012 Magnus ..... 206/216
2014/0028242 A1* 1/2014 Akin et al. ..... 320/101
2014/0366784 A1* 12/2014 Berger ..... 109/23

* cited by examiner

SOLAR WIRELESS BEACH CHAIR

CROSS-REFERENCE TO RELATED APPLICATIONS

This application claims the benefit of U.S. Provisional Patent Application 61/879,651, filed on Sep. 18, 2013, and incorporated herein by reference.

STATEMENT REGARDING FEDERALLY SPONSORED RESEARCH AND DEVELOPMENT

Not Applicable.

FIELD OF THE INVENTION

This invention relates to collapsible chairs, and more particularly to an improvement for collapsible chairs that provides solar electricity to wireless speakers for the chair.

DISCUSSION OF RELATED ART

When camping, at a park or parade, or during other activities where the use of a folding or collapsible chair is desirable, often the user of such a chair must bring a separate umbrella to provide shade and a separate portable radio to provide music or other audio programming to the user's general area. Collapsible beach chairs of the prior art do not include means for stabilizing or supporting an umbrella, nor do they provide means for powering a portable electronic device or a pair of speakers.

US Patent Application 2011/0265964 to Portis et al. on Nov. 3, 2011 teaches a solar-powered umbrella table, but such a device is not portable or collapsible. US Patent Application 2009/0058354 to Harriosn on Mar. 5, 2009 teaches a similar device.

U.S. Pat. No. 8,104,491 to Li on Jan. 31, 2012 teaches a stand-alone collapsible umbrella structure that includes solar panels on a top side for collecting solar energy in the form of electricity and storing the energy in a battery. Such a device makes no provision for working in conjunction with a collapsible chair, and is itself rather bulky to transport, particularly with a large stabilizing base that includes the battery. U.S. Pat. No. 6,923,194 to Li on Aug. 2, 2005, and US Patent Application 2010/0326849 to Trimarche et al. on Dec. 30, 2010, both teach similar devices.

Therefore, there is a need for an improvement for collapsible beach chairs that provides a means for supporting an umbrella and for powering a portable electronic device and speakers. Such a needed improvement would allow for use of a rechargeable battery, and USB or other ports for charging the portable electronic device. Such a needed device would be collapsible and easily stored or transported with the chair, and would be easy to assemble and disassemble. Further, such a needed invention would be relatively inexpensive to manufacture. The present invention accomplishes these objectives.

SUMMARY OF THE INVENTION

The present device is an improvement for a collapsible beach chair of the type having a pair of vertical back support posts and a pair of generally horizontal arm rests. The improvement comprises an umbrella mechanism that has a rigid support post fixed with an expandable canopy. The canopy includes at least one flexible solar panel fixed with a top surface of the canopy. Power lines electrically connect the at least one solar panel with an umbrella electrical connector.

A clamping mechanism allows for selectively supporting the umbrella mechanism with one of the back support posts of the chair. A chair electrical connector is fixed with the chair and is electrically and mechanically connectable with the umbrella electrical connector. An audio transducer is fixed with each armrest of the chair and electrically connected with the chair electrical connector through at least one power conduit. Each audio transducer is adapted for receiving a wireless audio signal and reproducing such signal audibly.

In one embodiment, a rechargeable battery is fixed with the chair and electrically connected to the chair electrical connector. As such, each audio transducer may be powered even with the umbrella mechanism detached from the chair. Such a battery is preferably rechargeable with the at least one solar panel, and preferably includes a selectively detachable battery electrical connector.

In one embodiment, at least one USB port is electrically connected with the chair electrical connector such that power from the at least one solar panel and/or battery is provided to the USB port for powering a portable electronic device, such as a mobile phone. In embodiments having the battery, each USB port may be electrically connected also to the battery such that when no power is received from the at least one solar panel the USB port is still provided with power from the battery.

A pair of flexible pockets may be further included for suspending from each arm rest of the chair. Each pocket encloses one of the audio transducers and includes a selectively closable opening for accessing an inside space of the pocket. One of the pockets may be adapted for receiving the battery therein.

In use, with the umbrella mechanism fixed to the chair with the clamping mechanism, and with the umbrella and chair electrical connectors mutually fixed together, the audio transducers are provided power through the at least one power conduit from the at least one solar panel and/or the battery to reproduce the audio signal.

The present invention is an improvement for collapsible beach chairs that provides a means for supporting an umbrella and for powering a portable electronic device and speakers. The present improvement provides for use of a rechargeable battery, and USB or other ports for powering or charging the portable electronic device, either with the battery or with one or more solar panels on a top side of the umbrella canopy. The present invention is collapsible and easily stored or transported with the chair, and is further easy to manufacture, assemble and disassemble. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
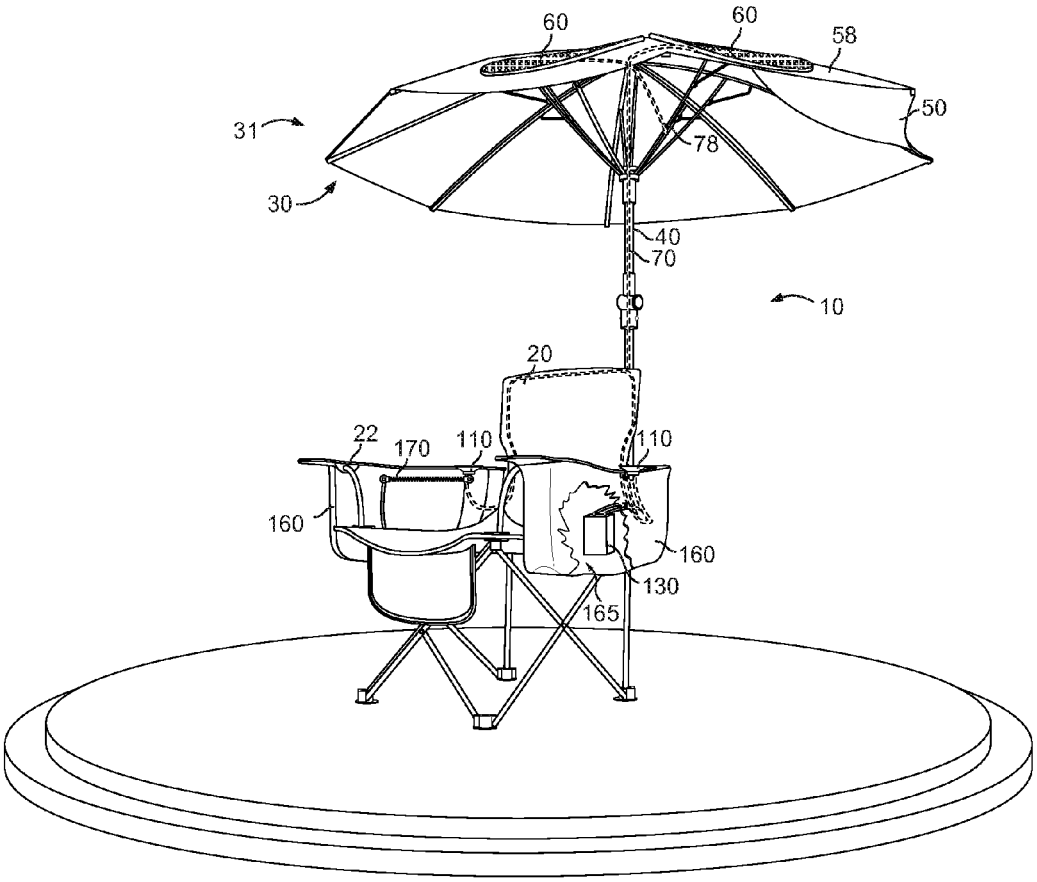
FIG. 1 is a perspective view of the invention, illustrating a plurality of solar panels on a top surface of an expandable canopy.
Figure 2:
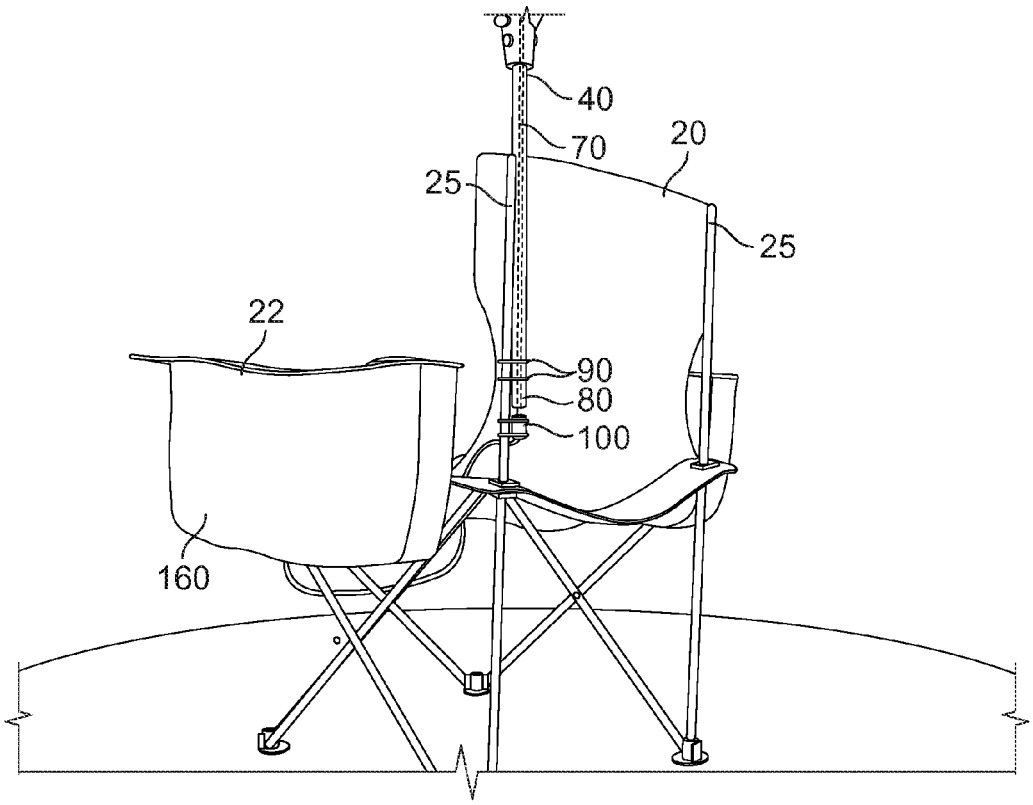
FIG. 2 is a partial rear perspective view of the invention, illustrating an umbrella and chair electrical connectors.

FIGS. 1 and 2 illustrate an improvement 10 for a collapsible beach chair 20 of the type having a pair of vertical back support posts 25 and a pair of generally horizontal arm rests 22. Such beach chairs 20 typically assume either an expanded configuration, as illustrated, or a collapsed configuration for convenient transport and storage (not shown).

The improvement 10 comprises an umbrella mechanism 30 that has a rigid support post 40 fixed with an expandable canopy 50 that can be positioned from a collapsed configuration 32 (FIG. 5) to an expanded configuration 31 (FIGS. 1 and 2). The canopy 50 includes at least one solar panel 60 fixed with a top surface 58 of the canopy 50. At least a pair of power lines 70 are electrically connected to the at least one solar panel 60 at a top end 78 thereof, and traverse through the support post 40 to terminate at a bottom end 72 thereof with an umbrella electrical connector 80 (FIGS. 2-5). A flexible carrying bag (not shown) may be included for storing and transporting the umbrella mechanism 30 when in its collapsed configuration 32. Such a flexible carrying bag may also be integrated with a flexible carrying back for holding the chair 20 when the chair 20 is in its collapsed configuration (not shown). The umbrella mechanism 30 may include mechanical means for moving the canopy 30 from the collapsed configuration 32 to the expanded configuration 31 as is known in the art.

Preferably the at least one solar panel 60 is a plurality of flexible or resilient solar panels 60 fixed with the top surface 38 of the canopy 30, such as by sewing or adhesive. Each flexible solar panel 60 is adapted to fold with the canopy 30 from the expanded configuration 31 to the collapsed configuration 32 without breaking.

Figure 4:
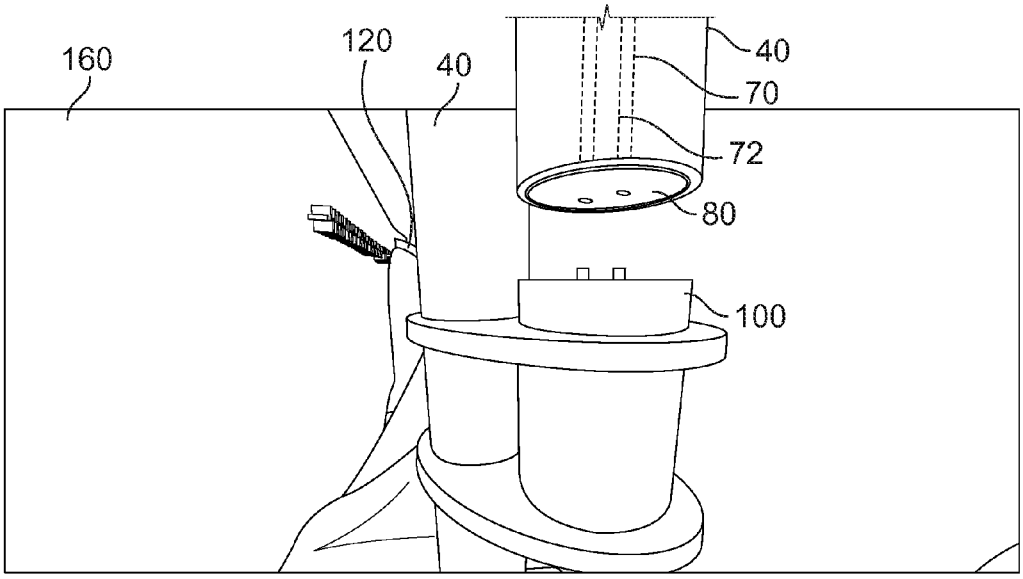
FIG. 4 is an enlarged, partial perspective view of the chair and umbrella electrical connectors.
Figure 5:
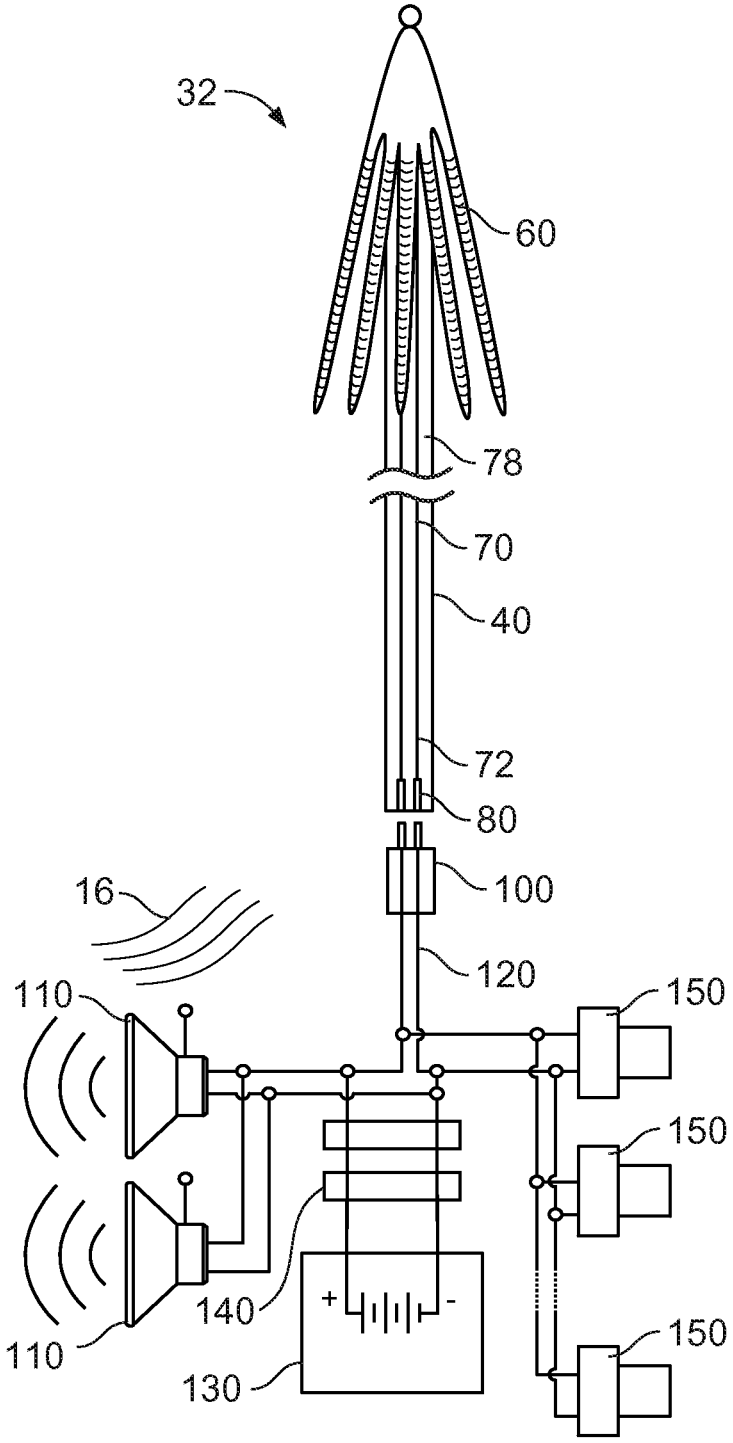
FIG. 5 is an electrical diagram of the invention.

A clamping mechanism 90 allows for selectively supporting the support post 40 and the rest of the umbrella mechanism 30 with one of the back support posts 25 of the chair 20. Such a clamping mechanism 90 may be a pair of brackets with an aperture therethrough for supporting the support post 40, as illustrated, or other clamping mechanisms 90 as are known in the art. A chair electrical connector 100 is fixed with the chair 20 and is electrically and mechanically connectable with the umbrella electrical connector 80 (FIGS. 4 and 5).

An audio transducer 110, such as a speaker, is fixed with each armrest 22 of the chair 20, each audio transducer 110 being electrically connected with the chair electrical connector 110 through at least one power conduit 120. Each audio transducer 110 is adapted for receiving a wireless audio signal 16 and reproducing such signal audibly. Preferably each audio transducer 110 is mounted flush with the arm rest 22 (FIG. 3) so as not to interfere with the use of a conventional use of the armrest 22.

In one embodiment, a rechargeable battery 130 is fixed with the chair 20 and electrically connected to the chair electrical connector 100. As such, each audio transducer 110 may be powered even with the umbrella mechanism 30 detached from the chair 20. Such a battery 130 is preferably rechargeable with the at least one solar panel 60, and preferably includes a selectively detachable battery electrical connector 140 so that the battery 130 may be removed from the chair 20 and replaced with a fully charged battery 130, for example. Preferably the battery 130 is a lithium-ion type battery having a capacity of at least 6500 mAh.

Figure 3:
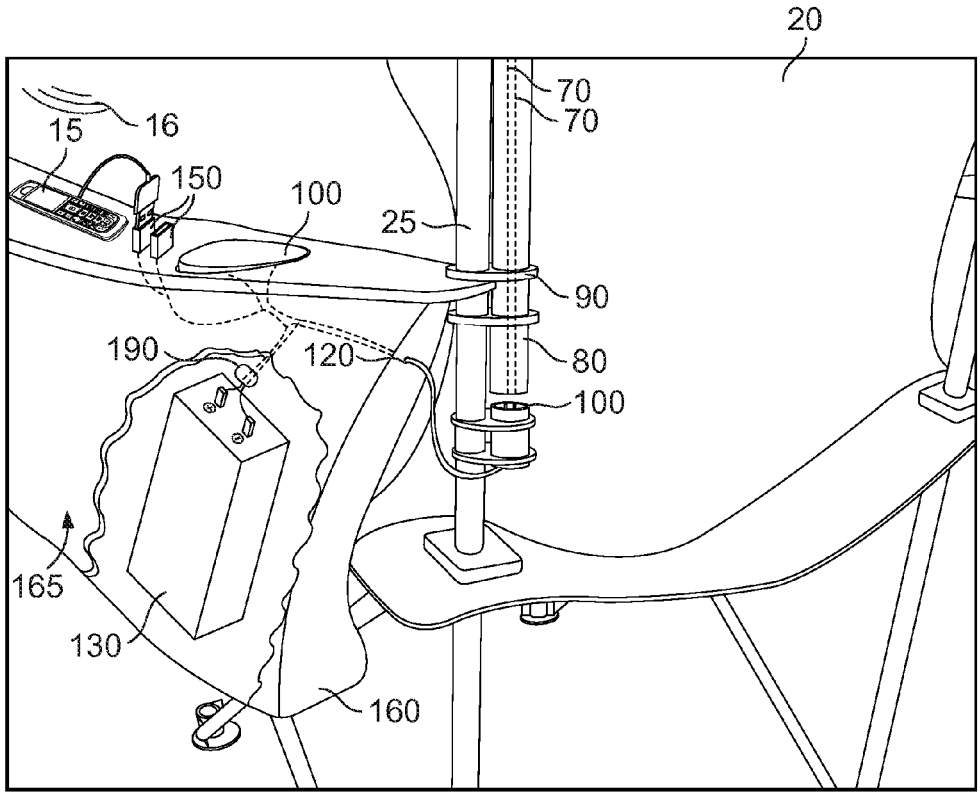
FIG. 3 is a partial rear perspective view of the invention, illustrating a flexible pocket suspended from an arm rest of the chair and containing a battery and an audio transducer.

In one embodiment, at least one USB port 150 is electrically connected with the chair electrical connector 100, such that power from the at least one solar panel 60 and/or battery 130 is provided to the USB port 150 for powering a portable electronic device 15, such as a mobile phone (FIG. 3). Such a USB port 150 may be fixed with the battery 130, each audio transducer 110, or independently fixed with the arm rest 22 or other portion of the chair 20. In embodiments having the battery 130, each USB port 150 may be electrically connected also to the battery 130 such that when no power is received from the at least one solar panel 60 the USB port 150 is still provided with power from the battery 130.

In use, with the umbrella mechanism 30 fixed to the chair 20 with the clamping mechanism 90, and with the umbrella and chair electrical connectors 80,100 mutually fixed together, the audio transducers 110 are provided power through the at least one power conduit 120 from the at least one solar panel 60 and/or the battery 130 to reproduce the audio signal 16. Such an audio signal 16 may be that broadcast by the portable electronic device 15, for example, through a suitable wireless protocol such as Bluetooth, or the like. Alternately, the audio signal 16 may be broadcast by a radio station or radio satellite (not shown), or the like.

Each audio transducer 110 may have its own wireless receiving circuitry (not shown) built-in, or only one of the audio transducers 110 may have the wireless receiving circuitry and be adapted for transmitting the audio signal to the other audio transducer 110 through a signal line (not shown) embedded in the chair 20, acting in a master/slave capacity.

A pair of flexible pockets 160 may be further included for suspending from each arm rest 22 of the chair 20. Each pocket 160 encloses one of the audio transducers 110 and includes a selectively closable opening 170 for accessing an inside space 165 of the pocket 160. Such an opening 170 may be closable with a zipper, a hook-and-loop type fastener, mechanical snaps, or the like. Each pocket 160 may further include audio insulation such that a back wave produced by the audio transducer 110 is at least partially muffled. One of the pockets 160 may be adapted for receiving the battery 130 therein.

While a particular form of the invention has been illustrated and described, it will be apparent that various modifications can be made without departing from the spirit and scope of the invention. For example, a different style of collapsible chair may be used with the improvement 10 than is illustrated in the figures. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An improvement for a collapsible beach chair of the type having a pair of vertical back support posts and a pair of horizontal arm rests, the improvement comprising:

an umbrella mechanism having a support post fixed with an expandable canopy, the canopy including at least one solar panel fixed with a top surface thereof, at least a pair of power lines electrically connected to the at least one solar panel at a top end thereof traversing through the support post which terminates at a bottom end thereof with an umbrella electrical connector;

a clamping mechanism for selectively supporting the support post with one of the back support posts of the chair;

a chair electrical connector fixed with the chair and electrically and mechanically connectable with the umbrella electrical connector;

an audio transducer fixed with each armrest of the chair and electrically connected with the chair electrical connector through a power conduit, each audio transducer adapted for receiving a wireless audio signal and reproducing such signal audibly;

whereby with the umbrella mechanism fixed to the chair with the clamping mechanism, and with the umbrella and chair electrical connectors mutually fixed together, the audio transducers are provided power through the power conduits to reproduce the audio signal.

2. The improvement of claim 1 wherein the at least one solar panel is a plurality of flexible solar panels fixed with the top surface of the canopy and adapted to fold with the canopy from an expanded configuration to a collapsed configuration.

3. The improvement of claim 1 further including a rechargeable battery fixed with the chair and electrically connected to the chair electrical connector, whereby each audio transducer may be powered even with the umbrella mechanism detached from the chair, the battery being rechargeable by the at least one solar panel.

4. The improvement of claim 3 wherein the rechargeable battery is electrically detachable from the audio transducers and the chair electrical connector at a battery electrical connector.

5. The improvement of claim 3 further including at least one USB port fixed with the battery and electrically connected with the chair electrical connector and the battery, whereby power from the at least one solar panel and battery is provided to the USB port for powering a portable electronic device.

6. The improvement of claim 3 wherein a flexible pocket is further included for suspending from each arm rest of the chair, each pocket enclosing one of the audio transducers, one of the pockets enclosing the battery, each pocket having a selectively closable opening for accessing an inside space of the pocket.

7. The improvement of claim 1 further including at least one USB port electrically connected with the chair electrical connector, whereby power from the at least one solar panel is provided to the USB port for powering a portable electronic device.

8. The improvement of claim 1 wherein a flexible pocket is further included for suspending from each arm rest of the chair, each pocket enclosing one of the audio transducers, each pocket having a selectively closable opening for accessing an inside space of the pocket.

* * * * *